US012317916B2

(12) United States Patent
Cha et al.

(10) Patent No.: US 12,317,916 B2
(45) Date of Patent: Jun. 3, 2025

(54) METHOD OF AGING SMOKING MATERIAL BY UTILIZING OAK BARREL AND SMOKING ARTICLE MANUFACTURED USING THE SAME

(71) Applicant: KT&G CORPORATION, Daejeon (KR)

(72) Inventors: Kwang Ho Cha, Daejeon (KR); Chul Hee Lee, Daejeon (KR); Han Jin Kim, Daejeon (KR); Jang Mi Lee, Daejeon (KR); Kwang Won Kang, Daejeon (KR); Nae Oh Chung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 897 days.

(21) Appl. No.: 17/296,587

(22) PCT Filed: Dec. 21, 2020

(86) PCT No.: PCT/KR2020/018750
§ 371 (c)(1),
(2) Date: May 25, 2021

(87) PCT Pub. No.: WO2021/167225
PCT Pub. Date: Aug. 26, 2021

(65) Prior Publication Data

US 2022/0125096 A1 Apr. 28, 2022

(30) Foreign Application Priority Data

Feb. 21, 2020 (KR) ..... 10-2020-0021382

(51) Int. Cl.
*A24B 3/12* (2006.01)
*A24B 3/04* (2006.01)
(Continued)

(52) U.S. Cl.
CPC ..... *A24B 3/12* (2013.01); *A24B 3/04* (2013.01); *A24B 5/10* (2013.01); *A24D 1/045* (2013.01); *A24D 1/20* (2020.01)

(58) Field of Classification Search
None
See application file for complete search history.

(56) References Cited

U.S. PATENT DOCUMENTS 4,192,323 A * 3/1980 Horne ..... A24B 1/02 131/303
4,730,629 A * 3/1988 Graves, Jr. ..... A24B 3/14 131/369
(Continued)

FOREIGN PATENT DOCUMENTS

CN 101041394 A 9/2007
CN 101416773 A 4/2009
(Continued)

OTHER PUBLICATIONS

Rense, W.C. The Perique Tobacco Industry of St. James Parish, Louisiana: A world monopoly. Econ Bot 24, 123-130 (1970). https://doi.org/10.1007/BF02860589 (Year: 1970).*
(Continued)

*Primary Examiner* — Philip Y Louie
*Assistant Examiner* — Jeffrey A. Buckman
(74) *Attorney, Agent, or Firm* — Sughrue Mion, PLLC

(57) ABSTRACT

An embodiment of the present disclosure provides a method of aging smoking materials for constituting at least a portion of a smoking material portion of a smoking article, the method including preparing an oak barrel and the smoking materials, putting the smoking materials into an inner space of the oak barrel, sealing the oak barrel, and aging the smoking materials.

15 Claims, 3 Drawing Sheets

(51) Int. Cl.

| | |
|---|---|
| ***A24B 5/10*** | (2006.01) |
| ***A24D 1/04*** | (2006.01) |
| ***A24D 1/20*** | (2020.01) |

(56) References Cited

U.S. PATENT DOCUMENTS

| | | | | |
|---|---|---|---|---|
| 9,364,012 | B2 | 6/2016 | Pellegrini | |
| 2005/0019027 | A1* | 1/2005 | Warren | F26B 3/30 392/417 |
| 2015/0037459 | A1* | 2/2015 | Chidambarakrishnan | B32B 27/325 426/11 |
| 2015/0093491 | A1 | 4/2015 | Pellegrini | |
| 2017/0042216 | A1 | 2/2017 | Gouinguene et al. | |
| 2021/0076730 | A1* | 3/2021 | Reinbold | A24B 13/00 |

FOREIGN PATENT DOCUMENTS

| | | | |
|---|---|---|---|
| CN | 101496633 | A | 8/2009 |
| CN | 101554247 | A | 10/2009 |
| CN | 101554248 | A | 10/2009 |
| CN | 103110181 | A | 5/2013 |
| CN | 108464524 | A | 8/2018 |
| CN | 109875108 | A | 6/2019 |
| JP | 6371928 | B1 | 8/2018 |
| KR | 10-2003-0063312 | A | 7/2003 |
| KR | 10-2007-0045327 | A | 5/2007 |
| KR | 10-2014-0077534 | A | 6/2014 |
| RU | 2636907 | C2 | 11/2017 |
| RU | 2641581 | C2 | 1/2018 |
| SU | 1720627 | A1 | 3/1992 |
| WO | 2017/115234 | A1 | 7/2017 |

OTHER PUBLICATIONS

Notification of Reason for Refusal dated Oct. 6, 2021 from the Korean Intellectual Property Office in KR application No. 10-2020-0021382.

International Search Report of PCT/KR2020/018750 dated Apr. 7, 2021 [PCT/ISA/210].

Office Action Issued Apr. 6, 2022 by the Chinese Patent Office in Chinese Application No. 202080005386.9.

Extended European Search Report dated Feb. 17, 2022 in European Application No. 20880327.0.

Communication dated Oct. 7, 2022 from the Russian Federal Institute of Industrial Property in Application No. 2022113041/03(027107).

* cited by examiner

METHOD OF AGING SMOKING MATERIAL BY UTILIZING OAK BARREL AND SMOKING ARTICLE MANUFACTURED USING THE SAME

CROSS REFERENCE TO RELATED APPLICATIONS

This application is a National Stage of International Application No. PCT/KR2020/018750, filed Dec. 21, 2020, claiming priority to Korean Patent Application No. 10-2020-0021382, filed Feb. 21, 2020.

TECHNICAL FIELD

The present disclosure relates to a method of aging smoking materials and a smoking article manufactured using the same, and more particularly, to a method of aging smoking materials, such as tobacco leaves, by utilizing an oak barrel and a smoking article manufactured using the same such that the favorable sensory quality and a flavor is improved as compared to existing smoking articles.

BACKGROUND ART

The taste of tobacco during smoking is determined by various factors such as the composition of a smoking material portion, a filter portion, and cigarette paper, but basically, the taste of tobacco is determined or affected by the composition of smoking materials constituting the smoking material portion (e.g., combustion portion), such as tobacco leaves or reconstituted tobacco leaves, additives such as fragrance components, and aging methods thereof.

Meanwhile, types of tobacco leaves used in cigarettes are somewhat limited, and the contents of flavoring materials that may be added to cigarettes are inevitably limited due to various factors such as the limited size of a cigarette and legal restrictions by relevant regulations.

Thus, in order to realize the taste of tobacco that suits smokers' preferences and to effectively deliver fragrance components, a new method of aging smoking materials is required.

DISCLOSURE

Technical Problem

The present disclosure is directed to providing a method of aging smoking materials by utilizing an oak barrel and a smoking article manufactured using the same capable of enhancing the taste and flavor of tobacco.

Objectives of the present disclosure are not limited to the above-mentioned objectives, and other unmentioned objectives should be clearly understood by those of ordinary skill in the art to which the present disclosure pertains from the description below.

Technical Solution

Some embodiments of the present disclosure provide a method of aging smoking materials, the method including preparing an oak barrel and the smoking materials, putting the smoking materials into an inner space of the oak barrel, sealing the oak barrel, and aging the smoking materials.

In some embodiments, the preparing of the smoking materials may include threshing tobacco leaves to obtain threshed tobacco leaves and humidifying the threshed tobacco leaves. Here, the humidifying of the threshed tobacco leaves may be performed such that the content of moisture in the threshed tobacco leaves is in a range of 10 wt % to 30 wt %.

Meanwhile, the tobacco leaves may include at least one of bright tobacco leaves, burley tobacco leaves, oriental tobacco leaves, cigar tobacco leaves, and Latakia tobacco leaves. Preferably, the tobacco leaves may be true leaves of the bright tobacco leaves or Basma leaves of the oriental tobacco leaves.

In some embodiments, the preparing of the oak barrel may include pouring wine or brandy into the oak barrel, sealing the oak barrel into which the wine or brandy is poured, and storing the oak barrel for a predetermined period, and after the predetermined period elapses, removing the wine or brandy remaining in the oak barrel.

In the removing of the wine or brandy, a weight of the wine or brandy remaining in the oak barrel may be in a range of 93% to 97% of a weight of the wine or brandy poured in the oak barrel.

In some embodiments, when the wine is poured into the oak barrel, the predetermined period and a capacity of the oak barrel may have the relationship of Equation 1, and when the brandy is poured into the oak barrel, the predetermined period and the capacity of the oak barrel may have the relationship of Equation 2. In Equation 1 and Equation 2, P represents the predetermined period in hours, and L represents the capacity of the oak barrel in liters.

$$P=1.5\times L \quad \text{[Equation 1]}$$

$$P=0.75\times L \quad \text{[Equation 2]}$$

In some embodiments, the putting of the smoking materials into the oak barrel may include stacking the smoking materials in the inner space of the oak barrel to form a first smoking material layer, pressing an upper surface of the first smoking material layer, which is formed by stacking the smoking materials, with a pressure in a range of 3 kgf/cm$^2$ to 10 kgf/cm$^2$, forming a first oak piece layer using oak pieces which include at least one of oak sticks, oak chips, oak plates, and oak sawdust, on the pressed upper surface of the first smoking material layer, and stacking the smoking materials to cover the first oak piece layer on the upper surface of the first smoking material layer to form a second smoking material layer.

Meanwhile, the total volume of the smoking materials and the oak pieces put into the oak barrel may be in a range of 85% to 95% of the total capacity of the inner space of the oak barrel. Here, the oak pieces may be toasted using far infrared rays.

In some embodiments, in the sealing of the oak barrel, an exterior of the oak barrel may be wrapped and sealed with a packing material such that air and moisture inside the packing material do not communicate with the outside of the packing material, and the aging of the smoking materials may be performed under a temperature in a range of 50° C. to 90° C. Meanwhile, the aging of the smoking materials may be performed for a period in a range of 7 days to 24 months.

Also, some embodiments of the present disclosure provide an aged tobacco leaf that is aged using the above-described aging method.

In some embodiments, a weight of at least one of 3-furaldehyde and 5-methyl furfural contained in the aged tobacco leaf may be larger than a weight of trans-geranylacetone contained in the aged tobacco leaf. Also, a weight of at least one of solanone, beta-damascone, beta-damascenone, neophytadiene, and megastigmatrienone contained in the aged tobacco leaf may be 2 times to 150 times larger than a weight of 6-methyl-5-heptene-2-one contained in the aged tobacco leaf.

Further, some embodiments of the present disclosure provide a smoking article including a smoking material portion which includes the aged tobacco leaf aged using the above-described aging method and a filter portion which is disposed downstream of the smoking material portion. Here, a weight of the aged tobacco leaf included in the smoking material portion may be in a range of 0.5% to 100% of the total weight of the smoking material portion.

Advantageous Effects

According to a method of aging smoking materials by utilizing an oak barrel according to some embodiments of the present disclosure, the quality of flavoring components of smoking materials can be improved in a desired way, and it is possible to simultaneously enhance the taste of tobacco and reduce the time and costs required for aging the smoking materials.

Also, through threshing and moisture content adjustment as a pretreatment process for aging using an oak barrel, it is possible to address a problem in that permeation of components through direct and indirect contact between the inside of the oak barrel and threshed tobacco leaves decreases in the aging process. Also, it is possible to optimize the amount of oxygen absorbed into the oak barrel and the binding promotion amounts of alcohol and organic acid. In this way, the efficiency of aging using the oak barrel can be improved.

Further, when putting smoking materials into an oak barrel, since a plurality of smoking material layers and a plurality of oak piece layers are alternately stacked, the process of aging the smoking materials using the oak barrel can be performed more efficiently.

Also, since the oak barrel into which the smoking materials are put is sealed by a packing material, which blocks the movement of air and moisture, in order to perform the aging process, loss of inherent flavoring components obtained inside and/or outside the oak barrel can be prevented and the spread of the flavoring components into tobacco leaves can be maximized in the aging process.

Since a smoking material portion of a smoking article according to embodiments of the present disclosure contains aged tobacco leaves manufactured by utilizing an oak barrel, the smoking article has sensory advantages such as a decrease in off-taste and irritation and an increase in softness during smoking, and further, the smoking article can minimize the addition of additional flavoring materials while producing an inherent deep flavor of tobacco and a specific favorable flavor.

MODES OF THE INVENTION

Figure 1:
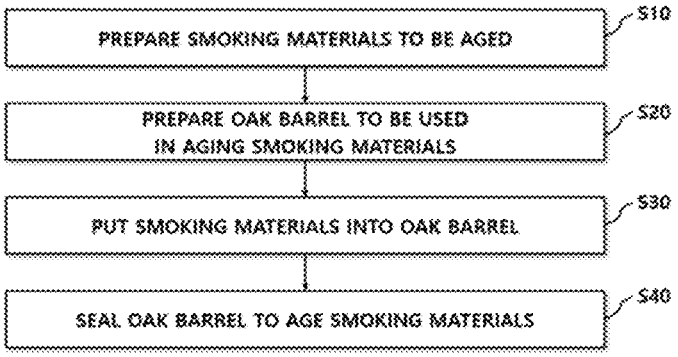
FIG. 1 is a flowchart illustrating a method of aging smoking materials according to some embodiments of the present disclosure.

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the present disclosure is not limited to the embodiments disclosed below and may be implemented in various other forms. The embodiments make the disclosure of the present disclosure complete and are provided to completely inform those of ordinary skill in the art to which the present disclosure pertains of the scope of the invention. The scope of the present disclosure is defined only by the scope of the claims. Like reference numerals refer to like elements throughout.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein.

Also, in the specification, a singular expression includes a plural expression unless the context clearly indicates otherwise. The terms "comprises" and/or "comprising" used herein do not preclude the presence of or the possibility of adding one or more elements, steps, operations, and/or devices other than those mentioned.

Terms including ordinals such as "first" or "second" used herein may be used to describe various elements, but the elements are not limited by the terms. The terms are only used for the purpose of distinguishing one element from another element.

Throughout the specification, "smoking article" may refer to anything capable of generating an aerosol, such as tobacco (cigarette) and cigars. The smoking article may include an aerosol-generating material or an aerosol-forming substrate. Also, the smoking article may include a solid material based on tobacco raw materials, such as reconstituted tobacco leaves, shredded tobacco, and reconstituted tobacco. A smoking material may include a volatile compound.

FIG. 1 is a flowchart illustrating a method of aging smoking materials according to some embodiments of the present disclosure.

Referring to FIG. 1, the method of aging smoking materials may include preparing smoking materials to be aged (S10), preparing an oak barrel to be used in aging the smoking materials (S20), putting the prepared smoking materials into an inner space of the prepared oak barrel (S30), and sealing the oak barrel to age the smoking materials (S40).

In the preparing of the smoking materials to be aged (S10), the smoking materials may be materials for constituting at least a portion of a cigarette medium portion, e.g., tobacco leaves or products of tobacco leaves.

More specifically, the preparing of the smoking materials may include: i) threshing tobacco leaves to obtain threshed tobacco leaves; and ii) humidifying the threshed tobacco leaves.

In some embodiments, in the humidifying of the threshed tobacco leaves, the content of moisture in the threshed tobacco leaves may be in a range of about 10 wt % to 30 wt %, and more preferably, in a range of 15 wt % to 25 wt % (for example, 20 wt %). In a case in which the content of moisture in the threshed tobacco leaves is below the above range, permeation of components through direct and indirect contact between the inside of the oak barrel and the threshed tobacco leaves decreases in the aging process. On the other hand, if the content of moisture in the threshed tobacco leaves exceeds the above range, the amount of oxygen absorbed into the oak barrel and the binding promotion amounts of alcohol and organic acid are decreased, and thus the efficiency of aging using the oak barrel is decreased.

Meanwhile, the tobacco leaves for the embodiments may be one or more tobacco leaves selected from bright tobacco leaves (for example, true leaves), burley tobacco leaves, oriental tobacco leaves (for example, Basma leaves), cigar tobacco leaves, and Latakia tobacco leaves. The type of tobacco leaves is not limited thereto, and other general leaves or special leaves may be used.

In the preparing of the oak barrel to be used in aging the smoking materials (S20), the oak barrel may be any one of a barrel used to age wine (wine barrel), a barrel used to age brandy (brandy barrel), or a barrel not used to age an alcoholic beverage (new barrel). When the new oak barrel is used, there is an advantage in that the spread of an inherent flavor of the oak barrel to the smoking materials may be maximized. When the wine oak barrel or brandy oak barrel is used, there is an advantage in that not only the inherent flavor of the oak barrel but also the wine or brandy component immersed in the oak barrel organically acts in the process of aging the smoking materials.

In some embodiments, the oak barrel may be a barrel made of any type of oak, preferably, a sweet oak barrel, and an inner side surface of the oak barrel may be toasted using far infrared rays. The internal capacity of the oak barrel to be used is not limited, but the internal capacity of the oak barrel may be in a range of about 50 L to 500 L (for example, 100 L, 225 L, or the like).

In a case in which the wine barrel or brandy barrel is used as the oak barrel, the preparing of the oak barrel (S20) may include: i) pouring wine or brandy into the oak barrel; ii) sealing the oak barrel, into which the wine or brandy is poured, to store the oak barrel for a predetermined period; and iii) after the predetermined period elapses, removing the wine or brandy remaining in the oak barrel. Here, a weight of the wine or brandy remaining in the oak barrel after the storing of the oak barrel for the predetermined period may be in a range of about 90% to 99%, preferably, about 93% to 97%, of a weight of the wine or brandy initially poured into the oak barrel. The wine or brandy reduced during the storage period may permeate into the oak barrel through the inner side surface of the oak barrel.

Meanwhile, the storage period may vary according to the type of alcoholic beverage to be stored in the oak barrel or according to the internal capacity of the oak barrel. For example, in oak barrels of the same capacity, the storage period of wine may be longer than the storage period of brandy.

More specifically, a storage period (P) of wine may be determined according to Equation 1 below, and a storage period (P) of brandy may be determined according to Equation 2 below. Here, P represents the storage period in hours, and L represents the capacity of the inner space of the oak barrel in liters.

$$P=1.5\times L \quad \text{[Equation 1]}$$

$$P=0.75\times L \quad \text{[Equation 2]}$$

For example, in the case of a 225-L oak barrel, wine may be stored for about two weeks (337.5[h]=1.5[h/L]×225[L]), and brandy may be stored for about a week (168.75 [h]=0.75 [h/L]×225 [L]).

When the smoking materials to be used and the oak barrel are prepared, the smoking materials are put into an inner space of the oak barrel (S30).

In the putting of the smoking materials into the oak barrel (S30), the smoking materials may be stacked to form a plurality of smoking material layers, and a plurality of oak piece layers, which are made of oak pieces (e.g., oak sticks, oak chips, oak plates, oak sawdust, and the like), may be formed between the plurality of smoking material layers. That is, the plurality of smoking material layers and the plurality of oak piece layers may be alternately stacked. Also, each smoking material layer constituting the plurality of smoking material layers may be formed as the smoking materials are put into the inner space of the oak barrel and then pressed with a predetermined pressure. In this way, the process of aging the smoking materials using the oak barrel may be more efficiently performed.

For example, in the putting of the smoking materials into the oak barrel (S30), i) putting a predetermined amount of smoking materials into the inner space of the oak barrel and pressing upper surfaces of the smoking materials with a predetermined pressure (for example, a pressure in a range of about 3 kgf/cm$^2$ to 10 kgf/cm$^2$) to form a first smoking material layer; ii) forming a first oak piece layer on an upper surface of the first smoking material layer; and iii) putting smoking materials to cover the first oak piece layer and then pressing the smoking materials with the above pressure to form a second smoking material layer may be repeatedly performed.

Here, the oak piece layer may completely cover the smoking material layer formed thereunder, or the oak piece layer may be formed so that portions of the upper surface of the smoking material layer formed thereunder are exposed between the oak pieces. Meanwhile, in order to improve the efficiency of aging the smoking materials, the oak pieces may be toasted using far infrared rays.

After the putting of the smoking materials (and the oak pieces) into the oak barrel is completed, an open upper surface of the oak barrel may be physically sealed by an oak barrel cover. Here, the total volume of the smoking materials (and the oak pieces) put into the oak barrel may be in a range of about 85% to 95% of the total capacity of the inner space of the oak barrel. That is, some upper portion of the inner space of the oak barrel may be filled with air necessary for the aging process.

The sealing of the oak barrel and aging the smoking materials (S40) may include: i) sealing the oak barrel with a packing material; and ii) storing the oak barrel, which is sealed with the packing material, under a predetermined temperature (for example, a temperature in a range of about 50° C. to 90° C., preferably, in a range of 65° C. to 75° C.) for a period in a range of about 7 days to 24 months (for example, about 2 weeks to 4 weeks). For example, the packing material may be a large vinyl bag or the like that accommodates the entire oak barrel and prevents air and moisture inside the packing material from communicating with the outside of the packing material during the storage period. Since the oak barrel is sealed by the packing material as described above, loss of inherent flavoring components obtained inside and/or outside the oak barrel may be prevented and the spread of the flavoring components into tobacco leaves may be maximized in the aging process.

The aged tobacco leaves obtained by completing the above-described aging process may be mixed in a process of manufacturing a smoking material portion 120, which will be described below with reference to FIG. 6. In this way, a smoking article including the smoking material portion 120 has sensory advantages such as a decrease in off-taste and irritation and an increase in softness, and further, the smoking article may produce an inherent deep flavor of tobacco and a specific favorable flavor during smoking even without the addition of artificial flavoring components.

Hereinafter, the configurations of the present disclosure and the advantageous effects according thereto will be described in more detail using examples and comparative examples. However, the examples are merely for describing the present disclosure in more detail, and the scope of the present disclosure is not limited by the examples.

Comparative Example 1

Bright tobacco leaves (true leaves) were threshed and then stored at room temperature for about 2 weeks.

Comparative Example 2

Bright tobacco leaves identical to those of Comparative Example 1 were threshed, put into a heat moisture treatment (HMT) container for aging, and then stored for about 2 weeks under conditions including a temperature of 72° C. and a tobacco leaf moisture content of 20% in order to manufacture aged tobacco leaves.

Embodiment Example 1

Bright tobacco leaves identical to those of Comparative Example 1 were threshed and put into a new 225-L oak barrel, an exterior of the oak barrel was sealed with a packing material, and then the oak barrel was stored for about 2 weeks under conditions including a temperature of 72° C. and a tobacco leaf moisture content of 20% in order to manufacture aged tobacco leaves.

Embodiment Example 2

Bright tobacco leaves identical to those of Comparative Example 1 were threshed and put into a 225-L wine oak barrel, in which wine was aged for about a week, an exterior of the oak barrel was sealed with a packing material, and then the oak barrel was stored for about 2 weeks under conditions including a temperature of 72° C. and a tobacco leaf moisture content of 20% in order to manufacture aged tobacco leaves.

Embodiment Example 3

Bright tobacco leaves identical to those of Comparative Example 1 were threshed and put into a 225-L brandy oak barrel, in which brandy was aged for about a week, an exterior of the oak barrel was sealed with a packing material, and then the oak barrel was stored for about 2 weeks under conditions including a temperature of 72° C. and a tobacco leaf moisture content of 20% in order to manufacture aged tobacco leaves.

Comparative Example 3

Oriental tobacco leaves (Basma leaves) were threshed and then stored at room temperature for about 2 weeks.

Comparative Example 4

Oriental tobacco leaves identical to those of Comparative Example 3 were threshed and put into a HMT container for aging, and then the HMT container was stored for about 2 weeks under conditions including a temperature of 72° C. and a tobacco leaf moisture content of 20% in order to manufacture aged tobacco leaves.

Embodiment Example 4

Oriental tobacco leaves identical to those of Comparative Example 3 were threshed and put into a new 225-L oak barrel, an exterior of the oak barrel was sealed with a packing material, and then the oak barrel was stored for about 2 weeks under conditions including a temperature of 72° C. and a tobacco leaf moisture content of 20% in order to manufacture aged tobacco leaves.

Experiment 1: Analysis of Flavoring Components in Tobacco Leaves of Embodiment Examples 1 to 4 and Comparative Examples 1 to 4

Flavoring components in the aged tobacco leaves according to the embodiment examples of the present disclosure were analyzed using a gas chromatography-mass spectrometry (GC-MS) measurement method. The result of analysis of the bright tobacco leaves is shown in Table 1, and the result of analysis of the oriental tobacco leaves is shown in Table 2. The numerical values of each component in Tables 1 and 2 represent peak area values (relative values) analyzed according to the GC-MS measurement.

TABLE 1

| Classification | Comparative Example 1 | Comparative Example 2 | Embodiment Example 1 | Embodiment Example 2 | Embodiment Example 3 |
|---|---|---|---|---|---|
| n-Pentyl alcohol | 25 | — | 9 | 82 | 119 |
| 3-Furaldehyde | 37 | 51 | 514 | 596 | 574 |
| 4-Methyl-1-hepten-4-ol | 13 | 21 | 165 | 149 | 144 |
| 5-Methyl furfural | 21 | 74 | 304 | 311 | 312 |
| Methyl-phenylacetate | 10 | 47 | 91 | 84 | 76 |

TABLE 1-continued

| Classification | Comparative Example 1 | Comparative Example 2 | Embodiment Example 1 | Embodiment Example 2 | Embodiment Example 3 |
|---|---|---|---|---|---|
| trans-Geranylacetone | 42 | 97 | 45 | 54 | 53 |
| 2,3-Dipyridyl | 19 | 60 | 60 | 74 | 59 |
| Methyl phenyl acetate | 10 | 47 | 91 | 84 | 85 |
| 6-Methyl-5-heptene-2-one | 37 | 15 | 11 | 13 | 12 |
| Solanone | 138 | 457 | 862 | 749 | 663 |
| beta-Damascone | 6 | 12 | 24 | 25 | 23 |
| beta-Damascenone | 15 | 109 | 174 | 171 | 150 |
| Neophytadiene | 584 | 932 | 1153 | 1220 | 960 |
| Benzyl Alcohol | 109 | 69 | 85 | 63 | 64 |
| Phenylethyl Alcohol | 161 | 108 | 198 | 291 | 280 |
| 2-Acetylpyrrole | 31 | 237 | 239 | 157 | 160 |
| 1-Methyl-3-pyrrolin-2-one | 6 | 32 | 36 | 31 | 28 |
| Megastigmatrienone | 16 | 132 | 177 | 168 | 183 |

TABLE 2

| Classification | Comparative Example 3 | Comparative Example 4 | Embodiment Example 4 |
|---|---|---|---|
| 6-Methyl-5-heptene-2-one | 45 | 76 | 95 |
| Solanone | 661 | 815 | 1537 |
| beta-Damascone | 19 | 18 | 25 |
| beta-Damascenone | 39 | 51 | 164 |
| Neophytadiene | 269 | 630 | 819 |
| Benzyl Alcohol | 83 | 102 | 113 |
| Phenylethyl Alcohol | 312 | 210 | 419 |
| 2-Acetylpyrrole | 35 | 135 | 146 |
| 1-Methyl-3-pyrrolin-2-one | 31 | 38 | 31 |
| Megastigmatrienone | 90 | 114 | 267 |
| Valeric acid | 4 | 19 | 25 |
| Isovaleric acid | 35 | 152 | 850 |
| 3-methyl valeric acid | 50 | 201 | 2432 |

Referring to Tables 1 and 2, in all of Examples 1 to 4 in which aging was performed using an oak barrel, as compared to Comparative Examples 2 to 4 in which aging was performed for the same period in a conventional HMT container, changes were observed in numerical values of components of the aged tobacco leaves. In particular, changes in numerical values were prominent for 3-furaldehyde, 5-methyl furfural, solanone, beta-damascone, beta-damascenone, neophytadiene, and megastigmatrienone among the flavoring components.

Specifically, it can be seen that, when aging was performed using an oak barrel, numerical values of 3-furaldehyde and 5-methyl furfural increased by a factor of about 15 as compared to Comparative Example 1 in which aging was not performed and increased by a factor of about 10 as compared to Comparative Example 2 in which aging was performed using HMT. In addition, it can be seen that numerical values of solanone, beta-damascone, beta-damascenone, neophytadiene, and megastigmatrienone also significantly increased as compared to when aging was performed using the existing HMT. Given that 3-furaldehyde and 5-methyl furfural are flavoring components which were also detected in the component analysis of the oak barrel itself, at least some of 3-furaldehyde and 5-methyl furfural detected in the aged tobacco leaves seem to have come from the oak barrel in the aging process. Further, in view of the high rate of increase of the components, it can be seen that the increase is significantly due to the synergistic effect caused by the decomposition of respective components contained in the oak barrel and the aged tobacco leaves in the oak barrel or by the synthesis of the components.

Referring to Table 1, during the aging process, although significant changes in numerical values of 6-methyl-5-heptene-2-one and benzyl alcohol, which are flavoring components generally detected in tobacco leaves, significant changes were observed in numerical values of 3-furaldehyde, 5-methyl furfural, solanone, beta-damascone, beta-damascenone, neophytadiene, and megastigmatrienone. In particular, in all of Embodiment Examples 1 to 3 in which aging was performed using an oak barrel, unlike in Comparative Example 2 in which aging was performed using HMT, the content (e.g., weight) of at least one of 3-furaldehyde and 5-methyl furfural contained in the aged tobacco leaves was found to be larger than the content (e.g., weight) of trans-geranylacetone contained in the aged tobacco leaves. Also, it can be seen that the weight of at least one of solanone, beta-damascone, beta-damascenone, neophytadiene, and megastigmatrienone contained in the aged tobacco leaves was larger than a weight of 6-methyl-5-heptene-2-one contained in the aged tobacco leaves by a factor of 2 to 150.

Referring to the result shown in Table 2, it can be seen that, in Embodiment Example 4 in which aging was performed using an oak barrel, unlike in Comparative Example 4 in which aging was performed using HMT, the content of solanone contained in the aged tobacco leaves was larger than the content of 6-methyl-5-heptene-2-one by a factor of about 15, the content of isovaleric acid contained in the aged tobacco leaves was larger than the content of phenylethyl alcohol, and the content of 3-methyl valeric acid contained in the aged tobacco leaves was larger than the content of phenylethyl alcohol. Also, referring to the result shown in Table 2, significant increases due to aging tobacco leaves were also observed in the contents of 6-methyl-5-heptene-2-one and benzyl alcohol, unlike in Embodiment Examples 1 to 3 in which no significant change was observed therefor.

Through the improvement of the quality of flavoring components of aged tobacco leaves as described above, it is predicted that a smoking article containing tobacco leaves aged using an oak barrel will improve sensory characteristics and produce a specific favorable flavor during smoking.

Meanwhile, in Experiment 1, in addition to the embodiment examples in which the aging process was performed for about 2 weeks, there were other embodiment examples in which aging was performed for about 4 weeks for each case. However, since significant changes due to the aging period difference between 2 weeks and 4 weeks were not observed in the sensory characteristics and the flavoring components, analysis of such embodiment examples has been omitted. According to the embodiment examples, it was found that an aging period in a range of about 5 days to 20 days is most efficient.

Also, in Experiment 1, in addition to the embodiment examples in which the oak barrel with an internal capacity of 225 L was used, there were other embodiment examples in which an oak barrel with an internal capacity of about 100 L was used for each case. However, since significant changes to a difference in the internal capacity of the oak barrel were not observed in the sensory characteristics and the flavoring components, analysis of such embodiment examples has been omitted. That is, the scope of the present disclosure is not limited to oak barrels having the above-mentioned internal capacities.

Comparative Example 5

A smoking material portion was removed from a regular cigarette manufactured for testing of embodiment examples, shredded tobacco was manufactured using the aged tobacco leaves (bright tobacco leaves) of Comparative Example 2, and then the smoking material portion was filled with the shredded tobacco to manufacture a smoking article.

Embodiment Example 5

A smoking article was manufactured in the same way as in Comparative Example 5 except that the shredded tobacco was manufactured using the tobacco leaves (bright tobacco leaves) aged using the new oak barrel of Embodiment Example 1, instead of using the aged tobacco leaves of Comparative Example 2, and then the smoking material portion was filled with the shredded tobacco.

Embodiment Example 6

A smoking article was manufactured in the same way as in Comparative Example 5 except that the shredded tobacco was manufactured using the tobacco leaves (bright tobacco leaves) aged using the wine oak barrel of Embodiment Example 2, instead of using the aged tobacco leaves of Comparative Example 2, and then the smoking material portion was filled with the shredded tobacco.

Embodiment Example 7

A smoking article was manufactured in the same way as in Comparative Example 5 except that the shredded tobacco was manufactured using the tobacco leaves (bright tobacco leaves) aged using the brandy oak barrel of Embodiment Example 3, instead of using the aged tobacco leaves of Comparative Example 5, and then the smoking material portion was filled with the shredded tobacco.

Comparative Example 6

A smoking material portion was removed from a regular cigarette manufactured for testing of embodiment examples, shredded tobacco was manufactured using the aged tobacco leaves (oriental tobacco leaves) of Comparative Example 4, and then the smoking material portion was filled with the shredded tobacco to manufacture a smoking article.

Embodiment Example 8

A smoking article was manufactured in the same way as in Comparative Example 6 except that the shredded tobacco was manufactured using the tobacco leaves (oriental tobacco leaves) aged using the new oak barrel of Embodiment Example 4, instead of using the aged tobacco leaves of Comparative Example 4, and then the smoking material portion was filled with the shredded tobacco.

Experiment 2: Sensory Evaluation of Embodiment Examples 5 to 8 and Comparative Examples 5 and 6

Sensory evaluation was performed with respect to tobacco smoke taste intensity, irritation, flavor intensity, satisfaction with the flavor, off-taste, refreshingness of aftertaste, and overall tobacco taste of the smoking articles. The sensory evaluation was performed by a panel of twenty-seven evaluators using the smoking articles manufactured according to the embodiment examples, based on a scale of 7 points.

Figure 2:
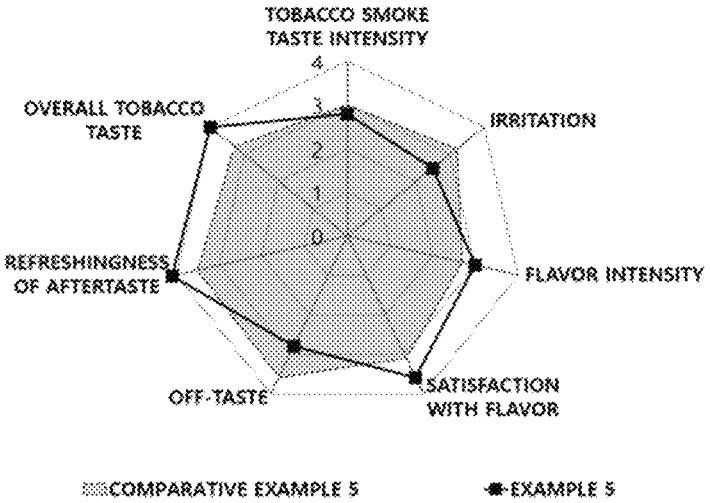
FIG. 2 is a view illustrating a comparison of results of sensory evaluation of smoking articles manufactured according to Embodiment Example 5 and Comparative Example 5.
Figure 3:
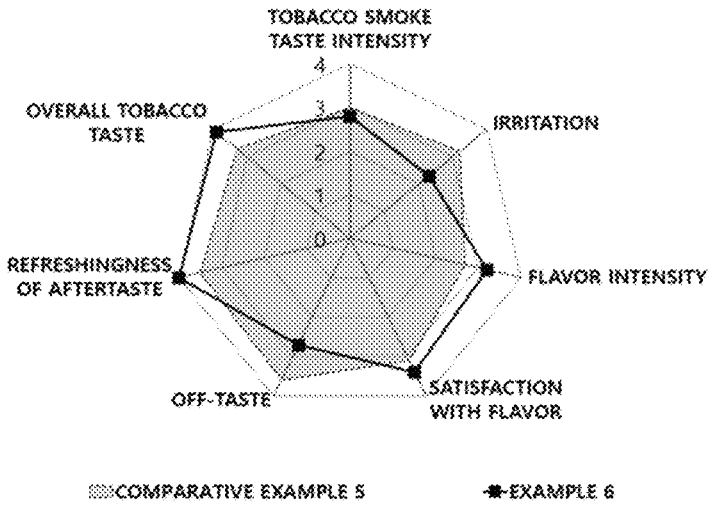
FIG. 3 is a view illustrating a comparison of results of sensory evaluation of smoking articles manufactured according to Embodiment Example 6 and Comparative Example 5.
Figure 4:
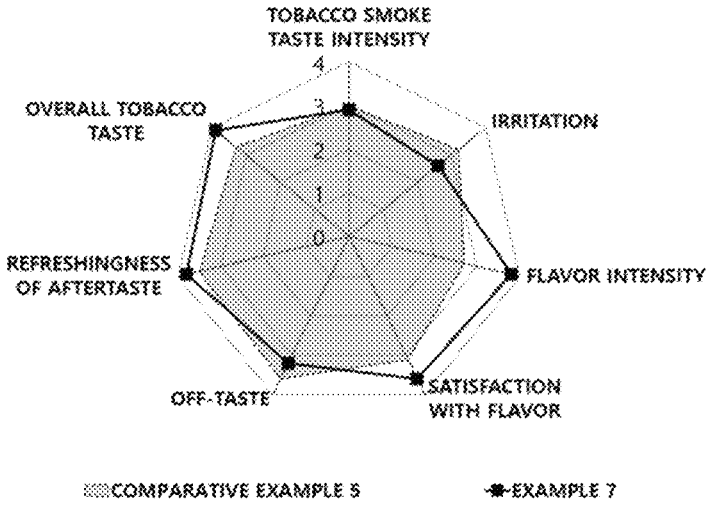
FIG. 4 is a view illustrating a comparison of results of sensory evaluation of smoking articles manufactured according to Embodiment Example 7 and Comparative Example 5.

Although the sensory evaluations of Embodiment Examples 5 to 7 were performed together, for clarity of description, the results thereof are separately illustrated in FIGS. 2 to 4. FIG. 2 is a view illustrating a comparison of results of sensory evaluation of smoking articles manufactured according to Embodiment Example 5 and Comparative Example 5, FIG. 3 is a view illustrating a comparison of results of sensory evaluation of smoking articles manufactured according to Embodiment Example 6 and Comparative Example 5, and FIG. 4 is a view illustrating a comparison of results of sensory evaluation of smoking articles manufactured according to Embodiment Example 7 and Comparative Example 5.

Referring to FIGS. 2 to 4, it can be seen that, in Embodiment Examples 5 to 7, irritation and off-taste decreased while flavor intensity, satisfaction with the flavor, refreshingness of aftertaste, and overall tobacco taste increased, as compared to Comparative Example 5.

In particular, it was found that the smoking articles of Embodiment Examples 5 and 6, in which the bright tobacco leaves aged using either the wine oak barrel or the new oak barrel were used, were the best in terms of the effect of reducing irritation and off-taste. On the other hand, it was found that the smoking article of Embodiment Example 7, in which the bright tobacco leaves aged using the brandy oak barrel were used, was the best in terms of the effect of improving flavor intensity and satisfaction with the flavor.

Figure 5:
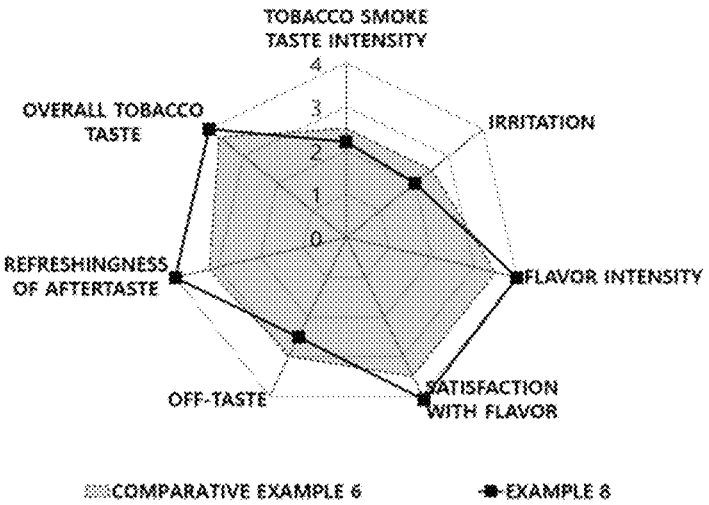
FIG. 5 is a view illustrating a comparison of results of sensory evaluation of smoking articles manufactured according to Embodiment Example 8 and Comparative Example 6.

FIG. 5 is a view illustrating a comparison of results of sensory evaluation of smoking articles manufactured according to Embodiment Example 8 and Comparative Example 6.

Referring to FIG. 5, it can be seen that, in Embodiment Example 8 in which the oriental tobacco leaves aged using the new oak barrel were used, irritation and off-taste decreased while flavor intensity, satisfaction with the flavor, refreshingness of aftertaste, and overall tobacco taste increased as compared to Comparative Example 6.

Comparing the sensory characteristics according to the type of tobacco leaves, it can be seen that irritation and off-taste decreased while flavor intensity, satisfaction with the flavor, and refreshingness of aftertaste relatively increased in the smoking article of Embodiment Example 8, in which the aged oriental tobacco leaves were used, as compared to the smoking articles of Embodiment Examples 5 to 7, in which the aged bright tobacco leaves were used. Such results seem to be due to an increase in the contents of inherent flavoring components such as valeric acid and isovaleric acid, which is caused by the aging using an oak barrel. In view of such results, the oriental tobacco leaves (for example, Basma leaves) aged using an oak barrel are expected to produce a sufficient flavor even when only a relatively small amount thereof is mixed in a smoking material portion.

Figure 6:
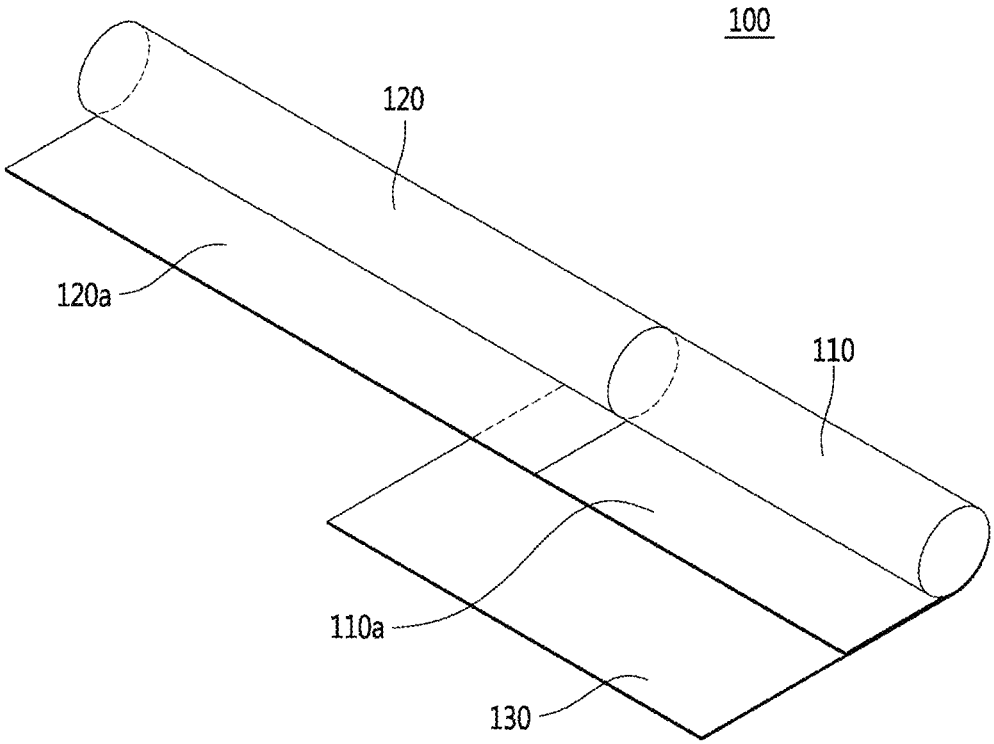
FIG. 6 is a view illustrating an exemplary configuration of a smoking article including tobacco leaves aged according to some embodiments of the present disclosure.

FIG. 6 is a view illustrating an exemplary configuration of a smoking article 100 including tobacco leaves aged according to some embodiments of the present disclosure.

In the specification, a case in which the smoking article 100 is a combustion-type cigarette is described as an example. However, the present disclosure is not limited thereto, and the smoking article 100 may also be a heating-type cigarette or the like that is used together with an aerosol generation device (not illustrated) such as an electronic cigarette device.

Meanwhile, "upstream" or "upstream direction" refers to a direction moving away from an oral region of a user smoking the smoking article 100, and "downstream" or "downstream direction" refers to a direction approaching the oral region of the user smoking the smoking article 100. For example, in the smoking article 100 illustrated in FIG. 6, the smoking material portion 120 is disposed upstream or in an upstream direction from a filter portion 110.

Referring to FIG. 6, the smoking article 100 may include the filter portion 110 wrapped by a filter wrapper 110*a*, the smoking material portion 120 wrapped by a smoking material wrapper 120*a*, and tipping paper 130 configured to combine the filter portion 110 and the smoking material portion 120.

The filter portion 110 may be disposed downstream of the smoking material portion 120 and may be a region through which an aerosol material generated in the smoking material portion 120 passes right before being inhaled by the user.

The filter portion 110 may be made of various materials. For example, the filter portion 110 may be a cellulose acetate filter.

In some embodiments, the filter portion 110 may be a cellulose acetate filter not flavored with a flavoring material, but the present disclosure is not limited thereto. The filter portion 110 may also be a transfer jet nozzle system (TJNS) filter flavored with a flavoring material.

In some embodiments, the filter portion 110 may be a tubular structure including a hollow formed therein. The filter portion 110 may also be manufactured by inserting structures such as films or tubes made of the same or different materials thereinto (for example, into the hollow).

Meanwhile, a hardness of the filter portion 110 may be adjusted by controlling the content of plasticizer during manufacture of the filter portion 110. Triacetin may be applied as a plasticizer, but the type and content of the plasticizer are not limited and may be properly adjusted as necessary.

The filter portion 110 of the present embodiment is illustrated as a mono filter formed of a single filter, but the present disclosure is not limited thereto. For example, the filter portion 110 may, of course, be provided as a dual filter which includes two acetate filters, a triple filter, or the like in order to increase filter efficiency.

Further, although not illustrated, a capsule (not illustrated) may be included inside the filter portion 110. The capsule may have a structure in which a liquid filled therein including a flavoring is wrapped by a film. For example, the capsule may have a spherical or cylindrical shape. Materials forming the film of the capsule may be a natural material, starch, and/or a gellant. For example, a film made of a natural material may be composed of agar, pectin, sodium alginate, glycerin, and the like. Gellan gum or gelatin may be used as the gellant. Also, a gelation auxiliary agent may be further used as a material forming the film of the capsule. As the gelation auxiliary agent, for example, calcium chloride may be used. Also, a plasticizer may be further used as a material forming the film of the capsule. Here, as the plasticizer, glycerin and/or sorbitol may be used. Also, a coloring agent may be further used as a material forming the film of the capsule.

In some embodiments, as a solvent of the flavoring included in the liquid contained in the capsule, for example, a medium chain fatty acid triglyceride (MCTG) may be used. The liquid may also contain other additives such as coloring matter, an emulsifier, and a thickener. A flavoring such as menthol and essential oil of plants may be included in the liquid contained in the capsule, but the present disclosure is not limited thereto.

The filter portion 110 is disposed downstream of the smoking material portion 120 to serve as a filter through which an aerosol material generated in the smoking material portion 120 passes right before being inhaled by the user.

The filter portion 110 may be wrapped by the filter wrapper 110*a*. In some embodiments, the filter wrapper 110*a* may be manufactured using grease-resistant wrapping paper. In order to prevent the liquid in the capsule, which is released to the outside of the capsule due to the smoker crushing the capsule, from passing through the filter wrapper 110*a*, the filter wrapper 110*a* may be manufactured using grease-resistant wrapping paper. In some embodiments, an aluminum foil may be further included at an inner surface of the filter wrapper 110*a*.

Meanwhile, the smoking material portion 120 may be wrapped by the smoking material wrapper 120*a*.

In some embodiments, glycerin and a combustion improver such as K-citrate and/or Na-citrate, which is configured to promote complete combustion of a smoking material by catalytic action or the like, may be added to the smoking material wrapper 120*a*. Further, fillers such as calcium carbonate, titanium dioxide, and magnesium oxide may be included in the smoking material wrapper 120*a*.

In some embodiments, the smoking material wrapper 120*a* may have a double wrapping paper structure. Specifically, the smoking material wrapper 120*a* may include an inner wrapper that comes in contact with the smoking material portion 120 and wraps around the smoking material portion 120 and an outer wrapper that comes in contact with the inner wrapper and surrounds the outside of the inner wrapper.

Further, the smoking material wrapper 120*a* may be low ignition propensity (LIP) cigarette paper having one or more LIP bands (not illustrated) formed therein.

An LIP band may lower the porosity of the smoking material wrapper 120*a*, and accordingly, when combustion of tobacco reaches the LIP band, an amount of oxygen entering the smoking material portion 120 may decrease, and the smoking article 100, which is burning, may be extinguished. Here, the LIP band may be a coating layer formed on an inner side surface and/or an outer side surface of the smoking material wrapper 120*a*.

The filter portion 110 wrapped by the filter wrapper 110*a* and the smoking material portion 120 wrapped by the smoking material wrapper 120*a* may be wrapped together by the tipping paper 130. That is, the tipping paper 130 may wrap around at least a portion (for example, a partial downstream region) of the smoking material wrapper 120*a* and an outer periphery of the filter wrapper 110*a*. Meanwhile, the tipping paper 130 may include an incombustible material to prevent a phenomenon in which the filter portion 110 is combusted as the smoking material portion 120 is combusted.

The smoking material portion 120 may be filled with raw tobacco leaves, reconstituted tobacco leaves, or a mixture of tobacco leaves and reconstituted tobacco leaves. The mixture may be filled in the form of a sheet or shredded tobacco in the smoking material portion 120. The smoking material portion 120 may have the form of a longitudinally extending rod which may have various lengths, circumferences, and diameters.

Also, the smoking material portion 120 may include at least one aerosol-generating material among glycerin, propylene glycol, ethylene glycol, dipropylene glycol, diethylene glycol, triethylene glycol, tetraethylene glycol, and oleyl alcohol.

Also, the smoking material portion 120 may contain other additives such as a flavoring agent, a wetting agent, and/or an acetate compound. For example, the flavoring agent may include licorice, saccharose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, coffee, or the like. Also, the wetting agent may include glycerin, propylene glycol, or the like.

In some embodiments, the smoking material portion 120 may include a reconstituted tobacco material which is formed in the shape of a rod or the like by grinding raw tobacco leaves and reconstituted tobacco leaves, mixing with a solvent and various additives to produce a slurry, drying the slurry to form a sheet, and then processing the sheet. For example, the smoking material portion 120 may include a plurality of reconstituted tobacco material strands, and each strand may have a length in a range of about 10 mm to 14 mm (for example, 12 mm), a width in a range of about 0.8 mm to 1.2 mm (for example, 1 mm), and a thickness in a range of about 0.08 mm to 0.12 mm (for example, 0.1 mm), but the present disclosure is not limited thereto.

Meanwhile, the taste of tobacco during smoking is mostly determined or affected by the type of smoking materials constituting the smoking material portion 120, whether fragrance components or the like are added, and an aging method thereof. Thus, in recent years, research has been carried out in various ways on technologies for diversifying the taste of tobacco or technologies for adding a flavor to an aerosol provided from cigarettes. However, the types of tobacco leaves used in cigarettes are somewhat limited, and the contents of fragrance components that may be added to cigarettes are also inevitably limited by various factors such as the limited size of a cigarette and legal restrictions by relevant regulations.

Since the smoking material portion 120 of the present disclosure includes the tobacco leaves aged by the above-described aging methods using an oak barrel, it is possible to realize the taste of tobacco that suits smokers' preferences while producing a specific favorable flavor.

Meanwhile, the tobacco leaves aged using an oak barrel according to embodiments of the present disclosure may be used at various mixing ratios to fill the smoking material portion 120. For example, only the tobacco leaves aged using an oak barrel that are cut in the form of shredded tobacco may be used to fill the smoking material portion 120 without being mixed with other smoking materials. Alternatively, the tobacco leaves aged using an oak barrel may be mixed with other smoking materials, such as tobacco leaves aged using materials other than oak, non-aged tobacco leaves, reconstituted tobacco leaves, toasted tobacco leaves, expanded shredded tobacco, and expanded tobacco midribs, and may be used to fill the smoking material portion 120. In this case, a weight of the tobacco leaves aged using an oak barrel that are included in the smoking material portion 120 may be in a range of about 0.5% to 100% of the total weight of the smoking material portion, but the present disclosure is not limited thereto.

Those of ordinary skill in the art related to the present embodiments should understand that the present disclosure may be implemented in modified forms within the scope not departing from essential characteristics of the above description. Therefore, the methods disclosed herein should be considered as illustrative rather than limiting. The scope of the present disclosure is defined by the claims below rather than by the above description, and all differences within the scope equivalent to the claims should be interpreted as falling within the scope of the present disclosure.

What is claimed is:

1. A method of aging smoking materials for constituting at least a portion of a smoking material portion of a smoking article, the method comprising:

preparing an oak barrel and the smoking materials;

putting the smoking materials into an inner space of the oak barrel;

sealing the oak barrel; and aging the smoking materials to obtain aged smoking materials, wherein in the sealing of the oak barrel, the entire oak barrel is accommodated and sealed in a packing material such that air and moisture inside the packing material do not communicate with outside of the packing material, wherein the preparing of the oak barrel includes:

pouring wine or brandy into the oak barrel;

sealing the oak barrel that contains the wine or brandy and storing the oak barrel for a predetermined period; and after the predetermined period elapses, removing the wine or brandy remaining in the oak barrel, wherein the aging of the smoking materials is performed at a temperature range of 65° C. to 90° C., and wherein the putting of the smoking materials into the oak barrel includes:

stacking the smoking materials in the inner space of the oak barrel to form a first smoking material layer;

pressing an upper surface of the first smoking material layer, which is formed by stacking the smoking materials;

forming a first oak piece layer using oak pieces which include at least one of oak sticks, oak chips, oak plates, and oak sawdust, on the pressed upper surface of the first smoking material layer; and stacking the smoking materials to cover the first oak piece layer on the upper surface of the first smoking material layer to form a second smoking material layer.

2. The method of claim 1, wherein the preparing of the smoking materials includes:

threshing tobacco leaves to obtain threshed tobacco leaves; and humidifying the threshed tobacco leaves.

3. The method of claim 2, wherein the humidifying of the threshed tobacco leaves is performed such that content of moisture in the threshed tobacco leaves is in a range of 10 wt % to 30 wt %.

4. The method of claim 2, wherein the tobacco leaves include at least one of bright tobacco leaves, burley tobacco leaves, oriental tobacco leaves, cigar tobacco leaves, and Latakia tobacco leaves.

5. The method of claim 4, wherein the tobacco leaves are true leaves of the bright tobacco leaves or Basma leaves of the oriental tobacco leaves.

6. The method of claim 1, wherein, in the removing of the wine or brandy, a weight of the wine or brandy remaining in the oak barrel is in a range of 93% to 97% of a weight of the wine or brandy poured in the oak barrel.

7. The method of claim 1, wherein:

when the wine is poured into the oak barrel, the predetermined period and a capacity of the oak barrel have the relationship of Equation 1; and when the brandy is poured into the oak barrel, the predetermined period and the capacity of the oak barrel have the relationship of Equation 2.2, $$P=1.5\times L \quad \text{[Equation 1]}$$

$$P=0.75\times L \quad \text{[Equation 2]}$$

in Equation 1 and Equation 2, P represent the predetermined period in hours, and L represents the capacity of the oak barrel in liters.

8. The method of claim 1, wherein the putting of the smoking materials into the oak barrel includes:

pressing the upper surface of the first smoking material layer, which is formed by stacking the smoking materials, with a pressure in a range of 3 $kgf/cm^2$ to 10 $kgf/cm^2$.

9. The method of claim 8, wherein a total volume of the smoking materials and the oak pieces put into the oak barrel is in a range of 85% to 95% of a total capacity of the inner space of the oak barrel.

10. The method of claim 8, wherein the oak pieces are toasted using far infrared rays.

11. The method of claim 1, wherein the aging of the smoking materials is performed for a period in a range of 7 days to 24 months.

12. The method of claim 3, wherein the humidifying of the threshed tobacco leaves is performed such that content of moisture in the threshed tobacco leaves is in a range of 10 wt % to 25 wt %.

13. The method of claim 1, wherein a weight of at least one of 3-furaldehyde and 5-methyl furfural contained in the aged tobacco materials is larger than a weight of trans-geranylacetone contained in the aged tobacco materials.

14. The method of claim 1, wherein a weight of at least one of solanone, beta-damascone, beta-damascenone, neophytadiene, and megastigmatrienone contained in the aged tobacco materials is 2 times to 150 times larger than a weight of 6-methyl-5-heptene-2-one contained in the aged tobacco materials.

15. The method of claim 1, wherein the aging of the smoking materials is performed at a temperature range of 72° C. to 90° C.

* * * * *